US010426277B2

(12) United States Patent
Cerri, III

(10) Patent No.: US 10,426,277 B2
(45) Date of Patent: Oct. 1, 2019

(54) INFLATABLE UNDER THE BED FILLER

(71) Applicant: Joseph Frank Cerri, III, Norwalk, OH (US)

(72) Inventor: Joseph Frank Cerri, III, Norwalk, OH (US)

( * ) Notice: Subject to any disclaimer, the term of this patent is extended or adjusted under 35 U.S.C. 154(b) by 0 days.

(21) Appl. No.: 16/293,907

(22) Filed: Mar. 6, 2019

(65) Prior Publication Data

US 2019/0191892 A1 Jun. 27, 2019

Related U.S. Application Data

(62) Division of application No. 15/096,326, filed on Apr. 12, 2016, now Pat. No. 10,258,168.

(51) Int. Cl.

| | |
|---|---|
| ***A47D 15/00*** | (2006.01) |
| ***A47C 19/22*** | (2006.01) |
| ***A47C 27/08*** | (2006.01) |

(52) U.S. Cl.

CPC ..... *A47D 15/00* (2013.01); *A47C 19/22* (2013.01); *A47C 27/081* (2013.01); *A47C 27/087* (2013.01)

(58) Field of Classification Search

CPC ..... A01K 1/035; A01K 1/0353; A47C 17/00; A47C 19/00; A47C 19/22; A47C 20/025; A47C 27/00; A47C 27/08; A47C 27/081; A47C 27/082; A47C 27/083; A47C 27/084; A47C 27/085; A47C 27/087; A47C 27/10; A47D 15/00; A47D 15/001; A47G 2009/003; A47G 9/00; A47G 9/02; A47G 9/0284; A47G 9/0292; A47G 9/10; A47G 9/1027; A47G 9/1054; A47G 9/0163; A63B 69/12; A63B 69/14; B63C 2009/0023; B63C 2009/042; B63C 9/00; B63C 9/02; B63C 9/04; B63C 9/24; B63C 9/28; B63C 9/30

USPC ..... 5/658–660, 615, 715, 488, 118

See application file for complete search history.

(56) References Cited

U.S. PATENT DOCUMENTS

| | | | | | |
|---|---|---|---|---|---|
| 1,772,310 | A * | 8/1930 | Hart | A61G 7/001 | 5/615 |
| 2,769,182 | A * | 11/1956 | Nunlist | A47C 20/048 | 5/615 |
| 3,299,447 | A * | 1/1967 | Dome | A47C 23/047 | 2/917 |
| 3,392,412 | A * | 7/1968 | Aymar | A47C 20/048 | 5/634 |
| 3,606,623 | A * | 9/1971 | Aymar | A47C 20/048 | 5/660 |
| 3,667,075 | A * | 6/1972 | Ballard et al. | A47C 20/048 | 5/722 |
| 3,717,885 | A * | 2/1973 | De Mare | A61G 7/001 | 5/607 |

(Continued)

*Primary Examiner* — Robert G Santos

(74) *Attorney, Agent, or Firm* — Dunlap Bennett & Ludwig PLLC

(57) ABSTRACT

A filler formed to fit underneath a bed frame is provided. The filler includes a membrane. The membrane may include a top layer, bottom layer, and a sidewall connecting the top layer and the bottom layer together. An internal pocket is formed within the membrane. The internal pocket is capable of receiving and retaining a gas, thereby making the membrane an inflatable membrane. A valve is secured to the membrane and forms a fluid connection from the internal pocket to an outside, allowing users to inflate and deflate the membrane.

3 Claims, 3 Drawing Sheets

(56) References Cited

U.S. PATENT DOCUMENTS 3,781,928 A * 1/1974 Swallert ..... A47C 20/048 5/660
4,287,620 A * 9/1981 Zur ..... A61G 7/015 297/10
4,309,783 A * 1/1982 Cammack ..... A47C 20/048 5/615
4,669,139 A * 6/1987 Richter, Jr. ..... B62D 33/0612 248/421
4,697,290 A * 10/1987 Alklind ..... A61G 7/001 5/632
4,745,645 A * 5/1988 McWilliams ..... A47C 21/06 5/659
4,807,313 A * 2/1989 Ryder ..... A47C 19/045 5/610
4,873,731 A * 10/1989 Williamson ..... A47C 20/048 5/615
4,989,281 A * 2/1991 Christensen ..... B62D 33/0612 296/190.02
5,244,452 A * 9/1993 Vaccaro ..... A61G 11/008 5/603
5,257,430 A * 11/1993 Yamaguchi ..... A47C 21/028 254/93 HP
5,313,679 A * 5/1994 Yamaguchi ..... A47C 19/045 254/93 HP
5,412,822 A * 5/1995 Kelly ..... A47C 4/54 5/654
5,416,939 A * 5/1995 Maalouli ..... A61G 7/005 128/845
5,522,099 A * 6/1996 Heier ..... A61G 7/0005 4/485
5,598,591 A * 2/1997 Kelley ..... A47C 17/80 254/122
6,493,886 B1 * 12/2002 Vanpage ..... A47C 17/80 296/190.02
6,665,898 B2 * 12/2003 Gordon ..... A47C 21/06 5/658
6,671,900 B2 * 1/2004 Davis ..... A47C 20/08 5/118
6,739,005 B2 * 5/2004 Davis ..... A47C 20/048 5/613
6,757,925 B1 * 7/2004 Toomer ..... A47C 20/048 5/509.1
6,795,989 B2 * 9/2004 Fairchild ..... A47C 21/028 5/488
6,834,404 B2 * 12/2004 Fletcher ..... A61G 7/1003 5/611
6,993,798 B1 * 2/2006 Roberts ..... A47C 17/80 5/118
7,346,951 B1 * 3/2008 Heaton ..... A61G 7/008 5/615
7,401,368 B1 * 7/2008 Saucedo ..... B62D 33/0612 5/118
7,849,541 B2 * 12/2010 Gauger ..... A47C 19/021 5/400
7,917,979 B2 * 4/2011 Amsler, Jr. ..... A47C 19/045 5/488
10,258,168 B2 * 4/2019 Cerri, III ..... A47C 27/081
2001/0044959 A1 * 11/2001 Davis ..... A47C 20/08 5/118
2003/0041378 A1 * 3/2003 Davis ..... A47C 20/048 5/615
2003/0101515 A1 * 6/2003 Gordon ..... A47C 21/06 5/659
2004/0068796 A1 * 4/2004 Fletcher ..... A61G 7/1003 5/611
2004/0133978 A1 * 7/2004 Fairchild ..... A47C 21/028 5/488
2009/0193580 A1 * 8/2009 Gauger ..... A47C 19/021 5/93.1
2010/0064434 A1 * 3/2010 Amsler, Jr. ..... A47C 19/045 5/488
2017/0290445 A1 * 10/2017 Cerri, III ..... A47C 27/081
2019/0191892 A1 * 6/2019 Cerri, III ..... A47C 27/081

* cited by examiner

INFLATABLE UNDER THE BED FILLER

CROSS-REFERENCE TO RELATED APPLICATION

This application is a divisional application of U.S. non-provisional application Ser. No. 15/096,326, filed Apr. 12, 2016, the contents of which are herein incorporated by reference.

BACKGROUND OF THE INVENTION

The present invention relates to filling the space underneath a bed and, more particularly, to an inflatable under the bed filler.

Some individuals, especially children, suffer from fear associated with certain open spaces in their sleeping area where it is difficult to observe that they are empty first-hand. These open spaces are generally located in the closet and under the bed in the sleeping area. The open space under the bed is usually present due the bed frame, a structure which establishes the mattress at an acceptable height. The individual in the sleeping area fears that these unobservable areas are occupied by apparitions, monsters or other imaginary entities, which disturbs a restful sleep. Other individuals, usually a parent or guardian, routinely have to intervene and show the affected individual that these open areas are unoccupied. This is accomplished by opening and illuminating the open spaces to physically establish that the area is unoccupied. Simple, verbal assurances are usually not sufficient; the affected individual must be shown that the area is unoccupied to alleviate the fear. The time to accomplish this further reduces the amount of restful sleep obtained, both for the affected individual and the assisting individual.

As can be seen, there is a need for a device that quickly shows an individual there is nothing harmful underneath a bed.

SUMMARY OF THE INVENTION

In one aspect of the present invention, a filler formed to fit underneath a bed frame comprises: a membrane comprising a top layer, a bottom layer, and an outer sidewall joining the top layer and the bottom layer together, wherein an internal pocket capable of receiving and retaining a gas is formed within the membrane; and a valve secured to the membrane and forming a fluid connection from the internal pocket to an outside, wherein the membrane comprises a plurality of corners, wherein a cutout portion is formed at each corner of the membrane.

In another aspect of the present invention, a method of filling a space under a bed comprises the steps of: providing a membrane comprising a top layer, a bottom layer, and an outer sidewall joining the top layer and the bottom layer together, wherein an internal pocket capable of receiving and retaining a gas is formed within the membrane; placing the membrane underneath a bed frame; inflating the internal pocket until the membrane expands and occupies a substantial portion of the space under the bed.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes an inflatable under the bed filler. The present invention provides a physical object occupying the previously empty space underneath a bed. The physical object is a tangible item preventing the unobservable area under the bed from being occupied by apparitions, monsters or other imaginary entities. This physical object, being inflatable and easy to set-up, remains in place under the bed for as long as the individual has this fear, so no reoccurrence of the fear will occur as long as it is in place. Individuals who are susceptible to a fear of the type described will not recognize the article as consisting of empty internal space, instead viewing it as a solid, completely filling the previously open space and alleviating any concern of anything else occupying the same. With this peace of mind, restful sleep is possible.

The present invention establishes a sense of security without requiring complex rationalization from the individual experiencing the fear. The understanding of a solid object occupying space and preventing other objects from occupying the same space is fundamental and established very early in an individual's development. Therefore, the present invention utilizes a simpler, earlier-established principal to accomplish the same goal as the complex rationalization required by other solutions. This will likely allow it to be effective at even younger ages than alternative solutions.

The present invention is an inflatable membrane in the shape of a modified rectangular cuboid. The modifications to the shape include four corner cutouts, sized to clear bed frame corner supports and a center cutout sized to clear a bed frame center support. The membrane may be manufactured in various sizes intended to match the standard bed frames established for various sized mattresses, and includes a thickness generally corresponding to the length of the support legs of these bed frames.

The present invention is formed by attaching the various membrane sheets along their adjoining corners to form the enclosed space that will allow inflation via gas pressure elevation. The present invention may further include internal supports to attach the top membrane to the bottom membrane in the center section of the device, preventing bulging when inflated. The present invention may also include a sealable orifice to allow inflation and deflation of the membrane. The present invention may include various types of text allowing the purpose of the device to be clearly communicated.

Figure 1:
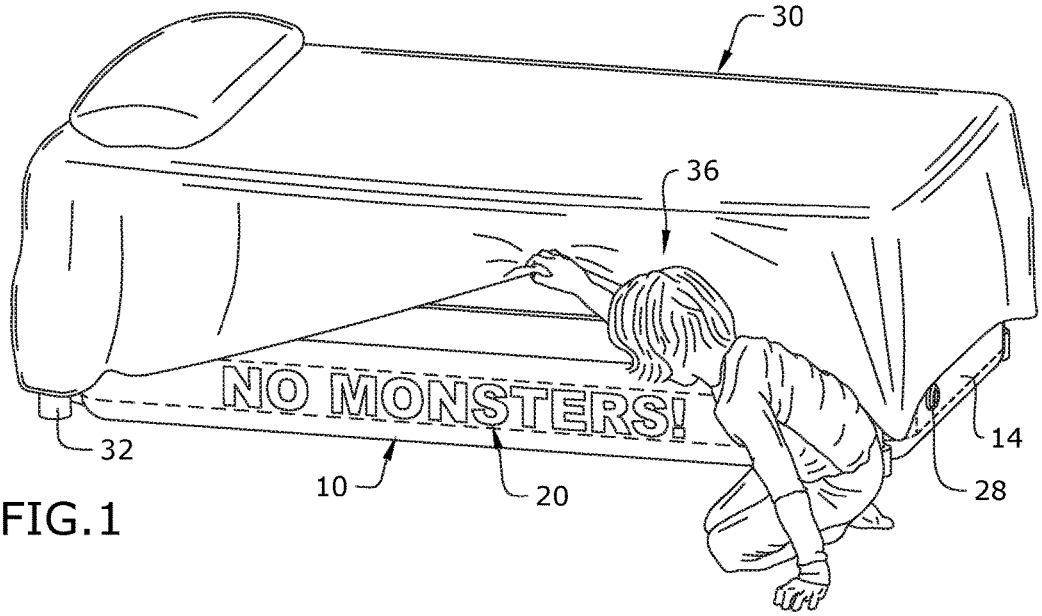
FIG. 1 is a perspective view of an embodiment of the present invention shown in use.
Figure 2:
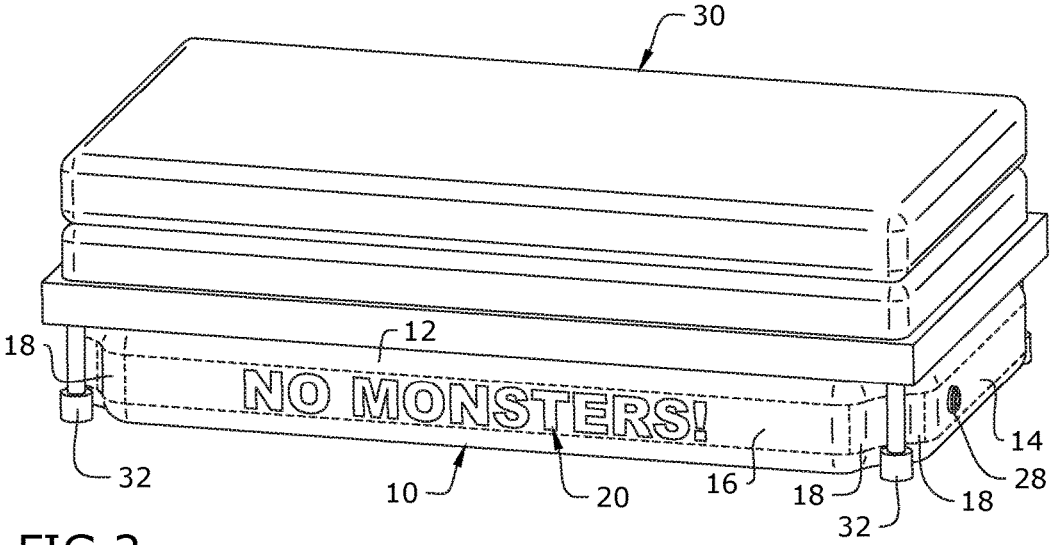
FIG. 2 is a perspective view of an embodiment of the present invention shown in use.
Figure 3:
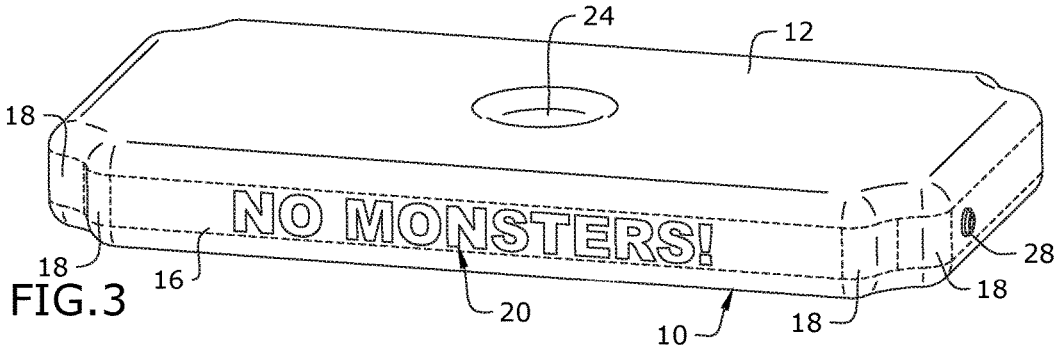
FIG. 3 is a perspective view of an embodiment of the present invention.
Figure 4:
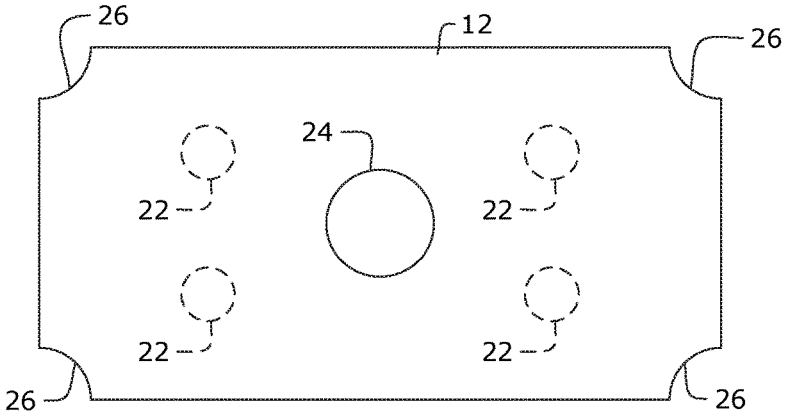
FIG. 4 is a top view of an embodiment of the present invention.
Figure 5:
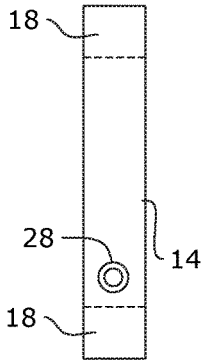
FIG. 5 is an end view of an embodiment of the present invention.
Figure 7:
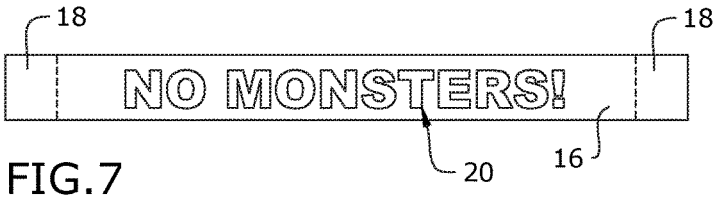
FIG. 7 is a side view of an embodiment of the present invention.
Figure 6:
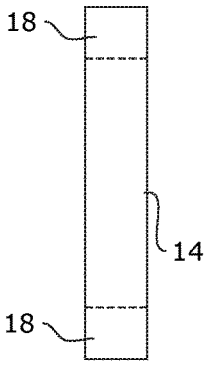
FIG. 6 is an end view of an embodiment of the present invention.
Figure 8:
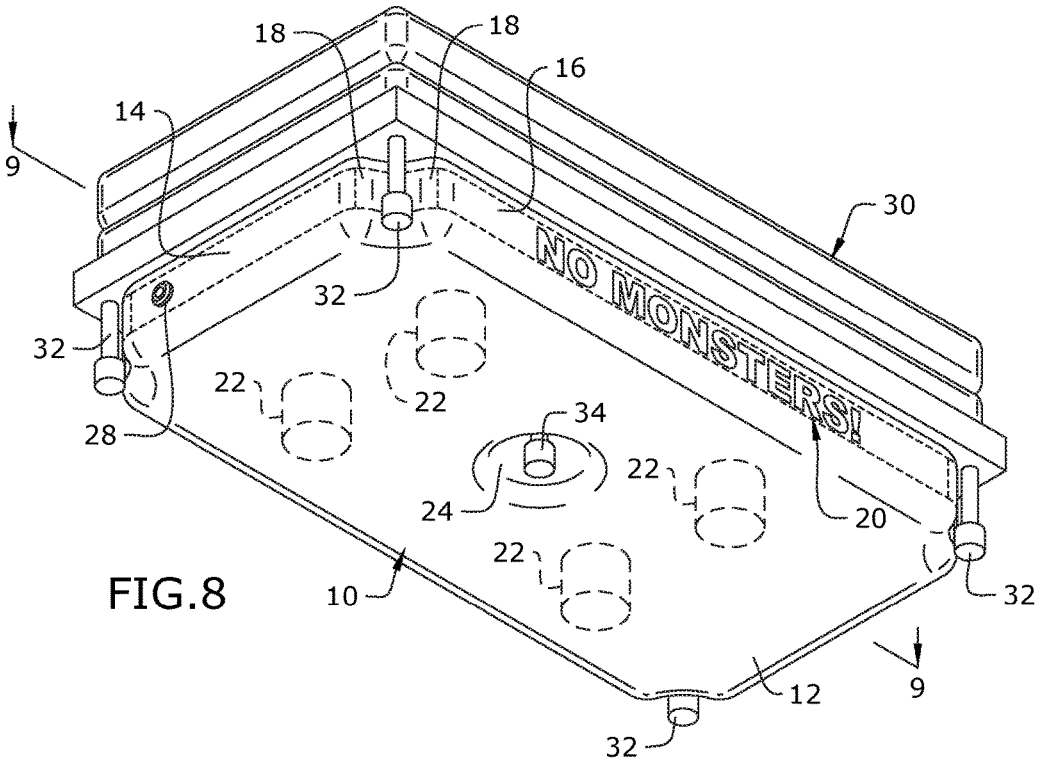
FIG. 8 is a bottom perspective view of an embodiment of the present invention in use.
Figure 9:
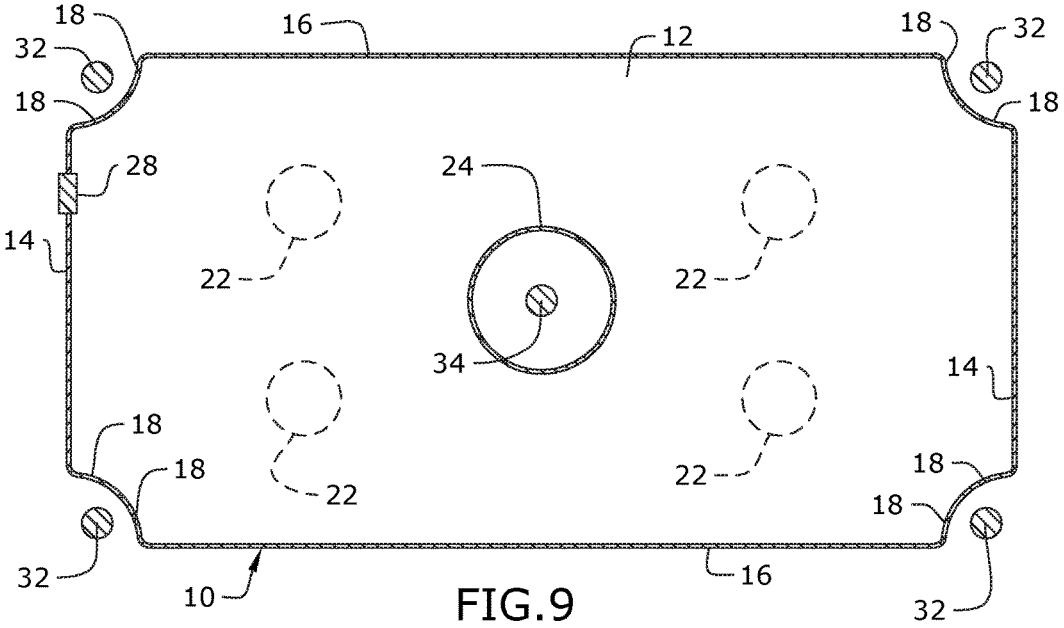
FIG. 9 is a bottom view of an embodiment of the present invention in use.

Referring to FIGS. 1 through 9, the present invention includes a filler formed to fit underneath a bed frame. The filler includes a membrane 10. The membrane 10 may include a top layer 12, bottom layer 12, and a sidewall 14, 16 connecting the top layer 12 and the bottom layer 12 together. The top and bottom layers 12 may be horizontally disposed, and the sidewall 14, 15 may be vertically disposed. An internal pocket is formed within the membrane 10. The internal pocket 10 is capable receiving and retaining a gas, thereby making the membrane 10 an inflatable membrane 10. A valve 28 is secured to the membrane 10 and forms a fluid connection from the internal pocket to an outside, allowing users 36 to inflate and deflate the membrane 10.

When the membrane 10 is inflated, the membrane 10 is shaped to occupy a substantial portion of the space underneath a bed 30. Therefore, the inflated membrane 10 may be a rectangular cuboid shape. In such embodiments, the outer sidewall 14, 16 includes a pair of end walls 14 and a pair of side walls 16.

To maximize space filled underneath the bed 30, the membrane 10 may include cut out portions 24, 26 designed to inflate around bed frame supports 32, 34. For example, a corner cut out portion 26 may be formed at each corner 18 of the rectangular cuboid shape. The corner cutout portions 26 are formed in the sidewall 14, 16 running from the bottom layer 12 to the top layer 12 and each having a concave shape bending inward. The corner cutout portions 26 are formed where the end walls 14 and the side walls 16 meet. The corner cutout portions 26 are formed to surround a portion of corner bed frame supports 32. The present invention may further include an inner sidewall forming a center cut out portion 24. The center cut out portion 24 is formed from the top layer 12 to the bottom layer 12 and is sized to receiving a center bed frame support 34 in between.

The present invention may further include internal supports 22. The internal supports 22 may be in the form of pillars that connect the top layer 12 and the bottom layer 22 together. In certain embodiments, there are four internal supports 22 evenly spaced around the internal sidewall in the center section of the membrane 10. The internal supports 22 may prevent bulging when the membrane 10 is inflated.

The present invention may further include a text 20. The text 20 may be disposed on the outer sidewall. The text size may be sufficiently large so that one looking under the bed 30 may clearly read the message. In certain embodiments, the message may indicate to the user 36 that no monsters are under the bed 30.

Set-up of the present invention may include the following. The membrane 10 is inserted under the bed 30 and inflated in place. The present invention is intended to substantially or completely fill the space under various sizes of standard bed frames. Elevated gas pressure inside the membrane 10 allows the present invention to inflate, matching the available space under the bed 30. The present invention, when in place, provides a physical object which directly prevents other physical objects (real or imagined) from occupying the same space. This basic principle is extremely easy to demonstrate to an user 36 who has a fear of an apparition, monster or other imaginary entity in the open space under the bed 30. Restful sleep can then commence after this demonstration, and repeated demonstrations should not be needed as long as the device remains in place.

The present invention may be made by utilizing existing manufacturing methods for fabricating inflatable objects such as, but not limited to, inflatable mattresses, swimming pools, swimming pool toys and the like. These manufacturing methods may include sealing the edges of the membranes, such a vinyl or other type of polymer material, with either direct heat or ultrasonic radiation. Internal supports may be added to prevent bulging. The valve may be affixed to a membrane section to allow access into the internal pocket and allow gas pressure to increase and inflate the membrane.

It should be understood, of course, that the foregoing relates to exemplary embodiments of the invention and that modifications may be made without departing from the spirit and scope of the invention as set forth in the following claims.

What is claimed is:

1. A method of filling a space under a bed comprising the steps of:

providing a membrane comprising a top layer, a bottom layer, and an outer sidewall joining the top layer and the bottom layer together, wherein an internal pocket capable of receiving and retaining a gas is formed within the membrane;

placing the membrane underneath a bed frame;

inflating the internal pocket until the membrane expands and occupies a majority of the space under the bed.

2. The method of claim 1, wherein the membrane comprises a plurality of cutout portions, wherein bed corner supports of the bed frame are disposed within the cutout portions.

3. The method of claim 1, wherein the membrane comprises an inner sidewall forming a center cutout portion, wherein a bed center support is disposed within the center cutout portion.

* * * * *